US008353239B1

(12) United States Patent
Patel

(10) Patent No.: US 8,353,239 B1
(45) Date of Patent: Jan. 15, 2013

(54) APPARATUS AND METHOD FOR DIRECTING THE LAUNCH OF A PROJECTILE

(75) Inventor: Umang R. Patel, Mansfield, TX (US)

(73) Assignee: Lockheed Martin Corporation, Grand Praire, TX (US)

( * ) Notice: Subject to any disclaimer, the term of this patent is extended or adjusted under 35 U.S.C. 154(b) by 446 days.

(21) Appl. No.: 12/129,669

(22) Filed: May 29, 2008

(51) Int. Cl.
*F41F 7/00* (2006.01)

(52) U.S. Cl. ..... 89/1.819

(58) Field of Classification Search ..... 89/1.8, 89/1.807, 1.808, 1.81, 1.813, 1.816, 1.818, 89/1.819, 1.809
See application file for complete search history.

(56) References Cited

U.S. PATENT DOCUMENTS 3,279,319 A * 10/1966 Semonian et al. ..... 89/1.81
4,134,327 A * 1/1979 Piesik ..... 89/1.8
4,185,538 A * 1/1980 Barakauskas ..... 89/1.81
4,854,260 A * 8/1989 Woidich et al. ..... 114/316
5,012,718 A * 5/1991 Miller ..... 89/1.816
5,149,906 A * 9/1992 August ..... 89/1.81
5,194,688 A * 3/1993 Piesik ..... 89/1.816
6,079,310 A * 6/2000 Yagla et al. ..... 89/1.816
6,971,300 B2 * 12/2005 Kunstmann ..... 89/1.816
7,207,254 B2 * 4/2007 Veitch et al. ..... 89/1.818
7,484,449 B2 * 2/2009 Shim et al. ..... 89/1.816
2003/0033926 A1 * 2/2003 MacLeod et al. ..... 89/1.81

* cited by examiner

*Primary Examiner* — Bret Hayes
*Assistant Examiner* — Reginald Tillman, Jr.
(74) *Attorney, Agent, or Firm* — Slater & Matsil, L.L.P.

(57) ABSTRACT

An apparatus for directing the launch of a projectile from a canister includes a pusher plate disposed in the canister, the pusher plate having a sliding, sealing engagement with the canister to define a closed volume, the projectile being disposed in the canister and resting on the pusher plate; and means for generating exhaust gas into the closed volume to urge the pusher plate and the projectile toward an opening of the canister. The apparatus further includes means for directing exhaust gas to affect the trajectory of the projectile.

14 Claims, 7 Drawing Sheets

APPARATUS AND METHOD FOR DIRECTING THE LAUNCH OF A PROJECTILE

BACKGROUND

1. Field of the Invention

The present invention relates to launching systems for projectiles, such as missiles, rockets, and the like.

2. Description of Related Art

Projectiles, such as missiles, rockets, and the like, are used in combat situations to destroy or disable enemy targets. It is desirable, if not necessary, for such a projectile to be suitably aimed toward a target prior to launch for optimum effectiveness. Conventional aiming mechanisms position the projectile and the launch canister in which the projectile is housed prior to launch into an altitude suitable to reach and strike the intended target. If, after a target has been identified, the projectile is already aimed generally in a suitable direction to strike the target, the projectile can be launched quickly. If, however, the projectile is not suitably aimed toward the target, the launch canister must be repositioned, thus delaying the projectile launch, as aerodynamically-controlled projectiles lack sufficient controllability to perform a rapid turn.

Such a delay can prove disastrous in some combat situations, especially when the projectile is used as a defensive munition against an incoming, moving target. The problem is magnified when defending an area from attacks that may come from many directions. The number of projectile launchers required to defend the area depends, at least in part, upon the slew rate of the projectile launcher aiming mechanisms. The slew rate is the distance the aiming mechanism can move the projectile in a given period of time. Lower slew rates are undesirable, as the extra time taken to direct or aim the projectile critically increases the overall time to respond to a threat. Larger response times result in greater numbers of projectile launchers being required to defend the area.

This problem is further magnified by projectile launch systems that include multiple projectiles and launch canisters that are grouped into a fixed set. In such configurations, simultaneous projectile launches, whether in the same direction or in different directions, may not be possible.

It is desirable for almost any combat equipment to be as lightweight and inexpensive as possible. Aiming mechanisms capable of faster slew rates, however, are heavier and more expensive than mechanisms capable of slower slew rates. Moreover, the weight, size, cost, and volume of canister aiming mechanisms grow dramatically with increasing slew rate. Furthermore, the weight, size, cost and volume of canister aiming mechanisms grow dramatically with increasing launch event forces and moments.

It is also desirable for the missile to have the largest effective range possible. The range is determined by its terminal velocity at this range. An aerodynamically controlled missile launched in a conventional manner expends a large amount of energy in a turn to achieve its desired flight path. The energy expended in the turn lowers the potential range of the interceptor.

There are many designs of projectile aiming mechanisms well known in the art; however, considerable shortcomings remain.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote(s) the first figure in which the respective reference numerals appear, wherein:

Figure 1:
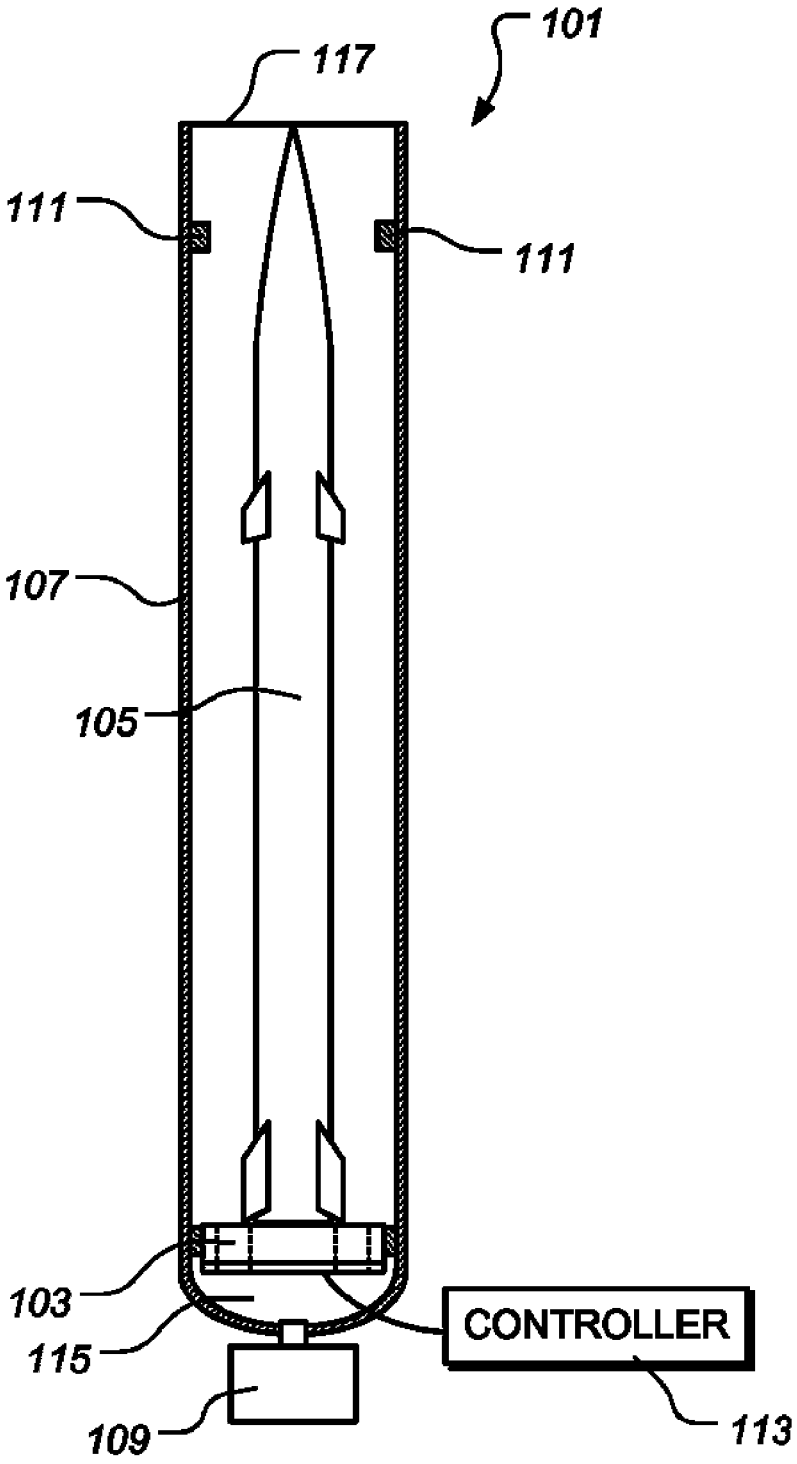
FIG. 1 is a stylized, side, elevational, partial cross-sectional view of a first illustrative embodiment of a projectile system.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents an apparatus and a method for affecting the launch trajectory of a projectile. Exhaust gases generated during launch from a canister are selectively routed so that the gases impinge upon one or more portions of the projectile as the projectile is traveling from the canister. Impingement of the exhaust gases onto the projectile imparts a force on the projectile that alters the trajectory of the projectile.

While the present invention contemplates many different embodiments of the apparatus for affecting the launch of a projectile, several particular embodiments are discussed herein. FIGS. 1-6 depict a first illustrative embodiment of a projectile system 101, which utilizes a selectively ported pusher plate 103 to redirect launch exhaust gases to alter the trajectory of a projectile 105. FIGS. 7-10 depict a second illustrative embodiment of a projectile system 701, which utilizes a set of valved conduits 703 to redirect launch exhaust gases to alter the trajectory of a projectile 705.

Turning now to the embodiment illustrated in FIG. 1, projectile system 101 comprises pusher plate 103, projectile 105, a canister 107, a launching engine 109 (an example of at least a portion of a launching means), pusher plate stops 111, and a controller 113. Controller 113 controls the operation of pusher plate 103, as is discussed in greater detail herein. Examples of projectile 105 include, but are not limited to, a rocket, missile, or the like, which is configured to rest on pusher plate 103 and to be launched from canister 107. A motive force to launch projectile 105 from canister 107 is provided by launching means 109. Launching means 109 may take on many different forms and may be disposed within canister 107 or outside of canister 107, as shown in FIG. 1. In the illustrated embodiment, launching means 109 is in fluid communication with an interior of canister 107. Canister 107 and pusher plate 103 form a substantially closed volume 115 within canister 107, except for the fluid communication with launching means 109, that increases as in size as projectile 105 is launched from canister 107. Launching means 109 provides the motive force to launch projectile 105 from canister by urging exhaust gases into closed volume 115, thus pressurizing closed volume 115. When pressure within closed volume 115 is sufficient, the pressure urges pusher plate 103 and projectile 105 toward an opening 117 of canister 107. In a preferred embodiment, pusher plate stops 111 inhibit pusher plate 103 from exiting canister 107 to reduce the likelihood of inadvertent damage to nearby equipment and/or inadvertent injury to nearby personnel.

Figure 2:
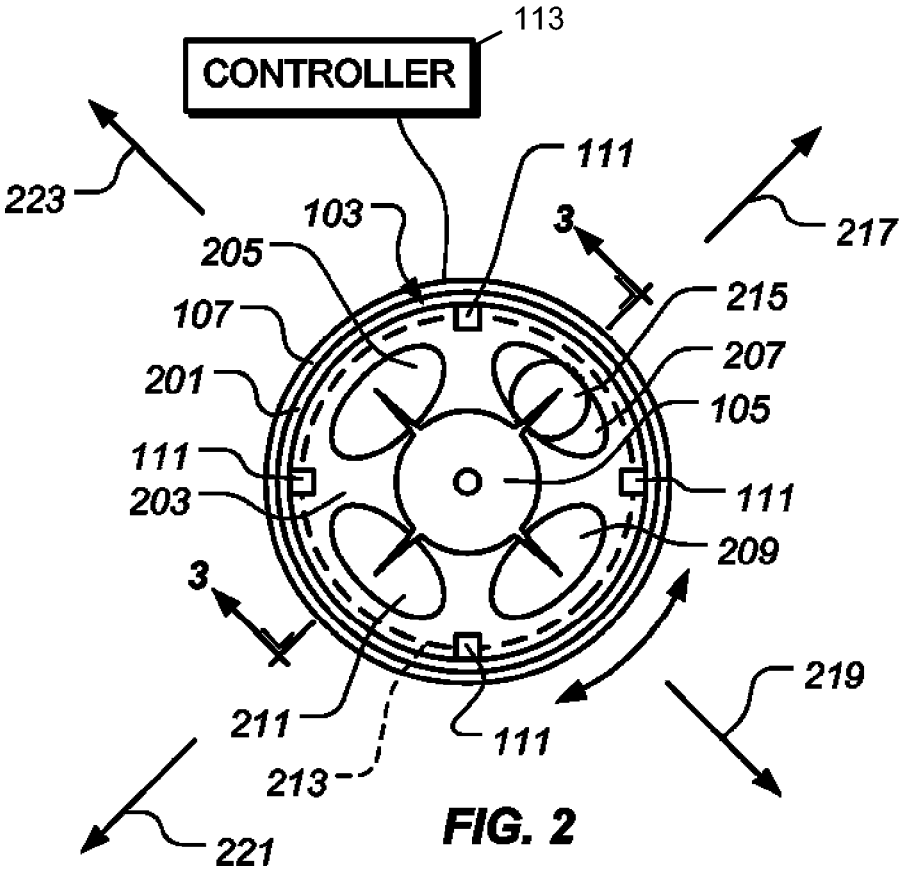
FIG. 2 is a stylized, top, plan view of the projectile system of FIG. 1.
Figure 3:
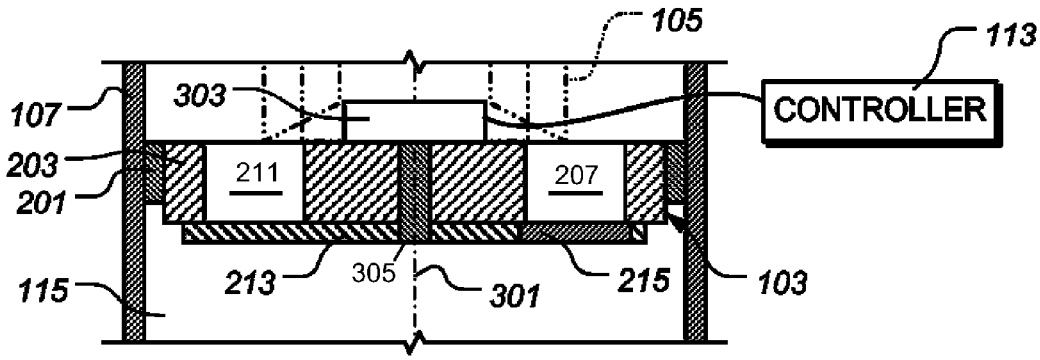
FIGS. 3 and 4 are stylized, side, elevational, partial cross-sectional views of a portion of the projectile system of FIG. 1.
Figure 4:
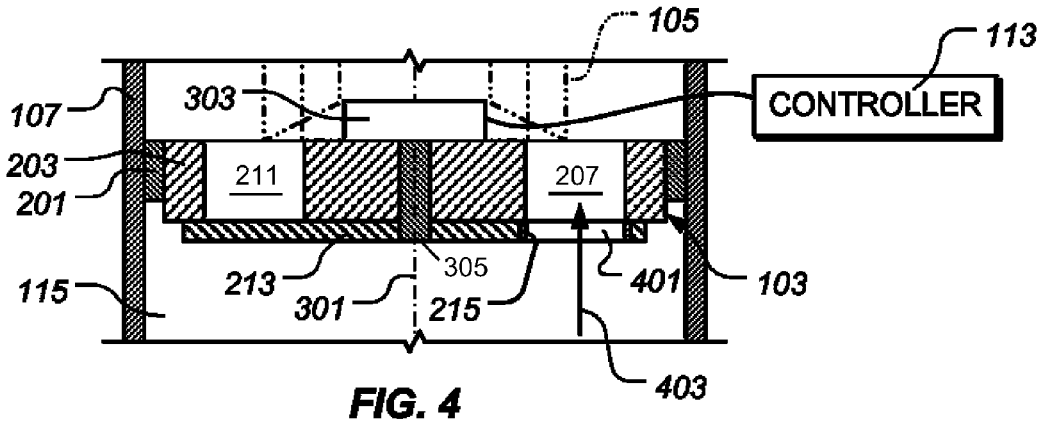

FIGS. 2 to 4 provide enlarged views of pusher plate 103, with projectile 105 shown in phantom in FIGS. 3 and 4. FIG. 2 is a top, plan view of projectile system 101, as viewed from opening 117 of canister 107. FIGS. 3 and 4 are cross-sectional views of a portion of projectile system 101 proximate pusher plate 103, taken along the line 3-3 in FIG. 2. Pusher plate 103 comprises a gasket 201 disposed about a multi-ported plate 203. Gasket 201 is fixed with respect to multi-ported plate 203 and is in a sliding but sealing engagement with canister 107. Multi-ported plate 203 defines a plurality of ports 205, 207, 209, and 211. It should be noted that, while the embodiment of multi-ported plate 203 depicted in the drawings defines four ports 205, 207, 209, and 211, the present invention contemplates multi-ported plate 203 defining any plurality of ports. Pusher plate 103 further comprises a single-ported plate 213 that rotates with respect to multi-ported plate 203 about a central, longitudinal axis 301 of canister 107. Single-ported plate 213 defines a breachable membrane 215 that can be generally aligned with one of ports 205, 207, 209, or 211. In the illustrated embodiment, a rotating means 303 is operably associated with single-ported plate 213 via a shaft 305 to selectively rotate single-ported plate 213 about axis 301, as indicated by a double-headed arrow 217 in FIG. 2. Rotating means 303 may comprise any suitable drive motor or drive train for rotating single-ported plate 213. Controller 113 operates rotating means 303 and may form a part of the fire control computer of projectile system 101.

In operation, single-ported plate 213 is rotated so that breachable membrane 215 is generally aligned with one of ports 205, 207, 209, or 211. In FIGS. 2 to 4, breachable membrane 215 is shown generally aligned with port 207. A particular port of ports 205, 207, 209, and 211 is selected depending upon how the trajectory of projectile 105 is to be affected, as discussed in greater detail herein. When exhaust gases build in closed volume 115 to a sufficient pressure, breachable membrane 215 mechanically fails, leaving an open port 401 through single-ported plate 213 as illustrated in FIG. 4. Exhaust gases being delivered into closed volume 115 escape through port 401 of single-ported plate 213 and one of ports 205, 207, 209, and 211 (depending upon the rotational position of single-ported plate 213), as indicated by an arrow 403, proximate projectile 105.

Figure 5:
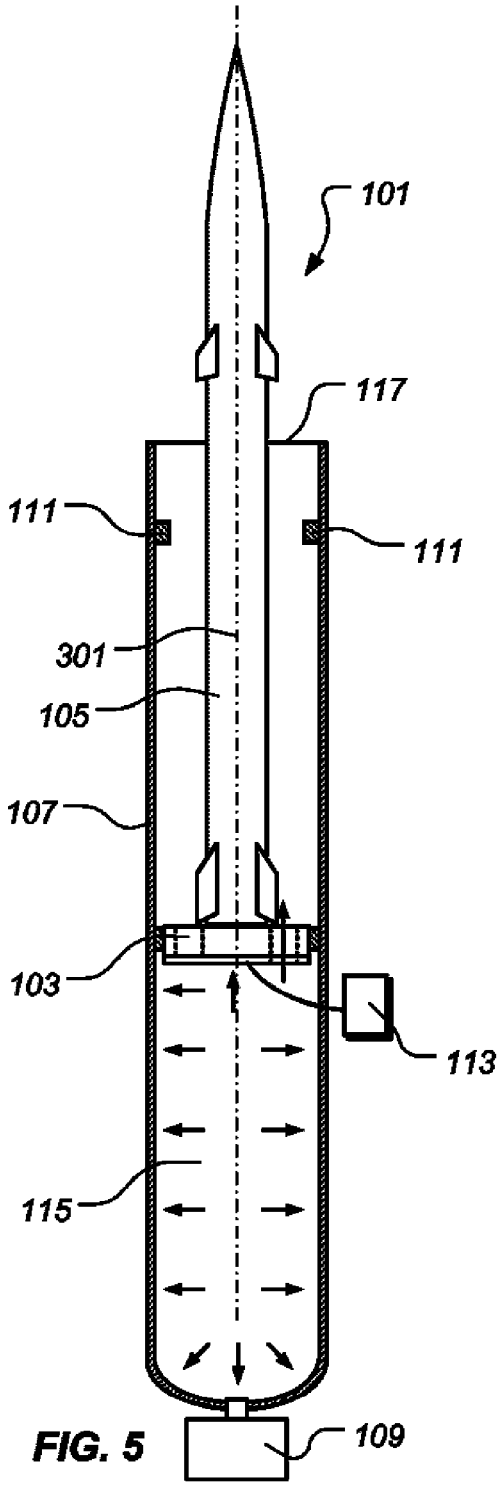
FIGS. 5 and 6 are stylized, side, elevational, partial cross-sectional views of the projectile system of FIG. 1 depicted in one particular mode of use.
Figure 6:
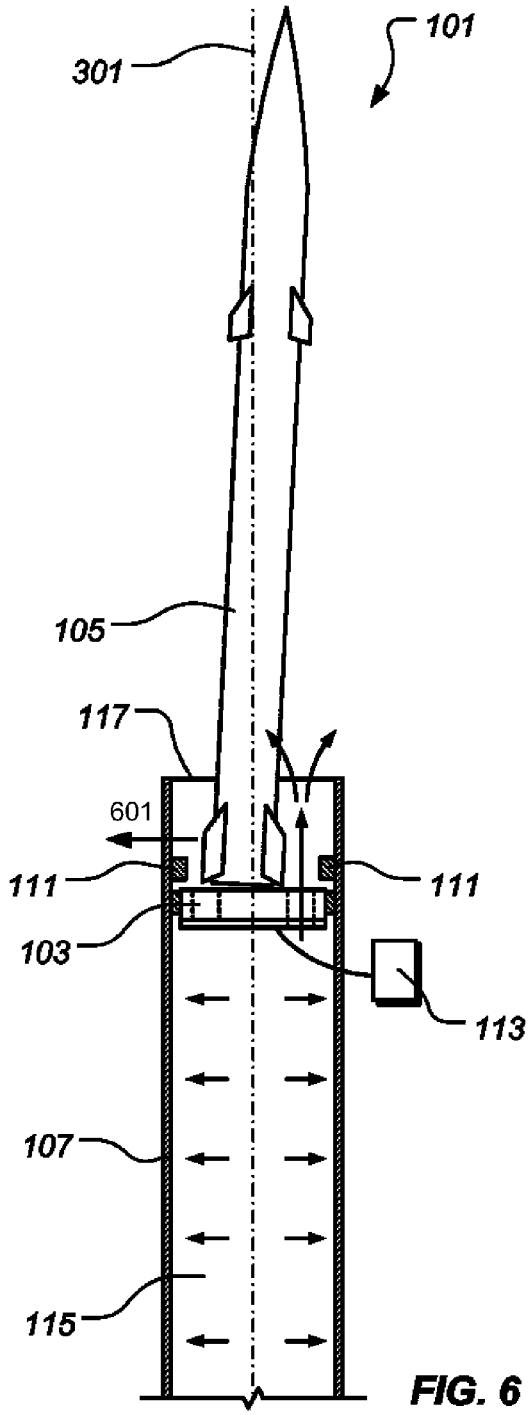

FIGS. 5 and 6 illustrate projectile system 101 in one particular operational configuration. As discussed herein, pusher plate 103 and projectile 105 are urged toward opening 117 of canister 107 as exhaust gases are introduced into closed volume 115 of canister 107. After breachable membrane 215 is breached by the exhaust gas pressure in closed volume 115, exhaust gases flow through port 401 of single-ported plate 213 (shown in FIG. 4) and one of ports 205, 207, 209, and 211 (best shown in FIG. 2). As shown in FIG. 6, the exhaust gases that have flowed through port 401 and one of ports 205, 207, 209, and 211 impinge on projectile 105, creating a lateral force (represented by an arrow 601) acting on projectile 105. Lateral force 601 moves projectile 105 with respect to pusher plate 103 and skews the orientation of projectile 105 with respect to axis 301. Thus, the exhaust gases that flow through port 401 and one of ports 205, 207, 209, and 211 affect the trajectory of projectile 105.

In the configuration depicted in FIGS. 2-6, exhaust gases passing through port 401 and port 207 causes projectile 105 to be steered in a direction generally corresponding to an arrow 217 of FIG. 2 during launch. Referring in particular to FIG. 2, if single-ported plate 213 is oriented such that breachable membrane 215 corresponds with port 209 of multi-ported plate 203, projectile 105 is steered in a direction generally corresponding to an arrow 219 during launch. Similarly, if single-ported plate 213 is oriented such that breachable membrane 215 corresponds with port 211 of multi-ported plate 203, projectile 105 is steered in a direction generally corresponding to an arrow 221 during launch. If single-ported plate 213 is oriented such that breachable membrane 215 corresponds with port 205 of multi-ported plate 203, projectile 105 is steered in a direction generally corresponding to an arrow 223 during launch.

Figure 7:
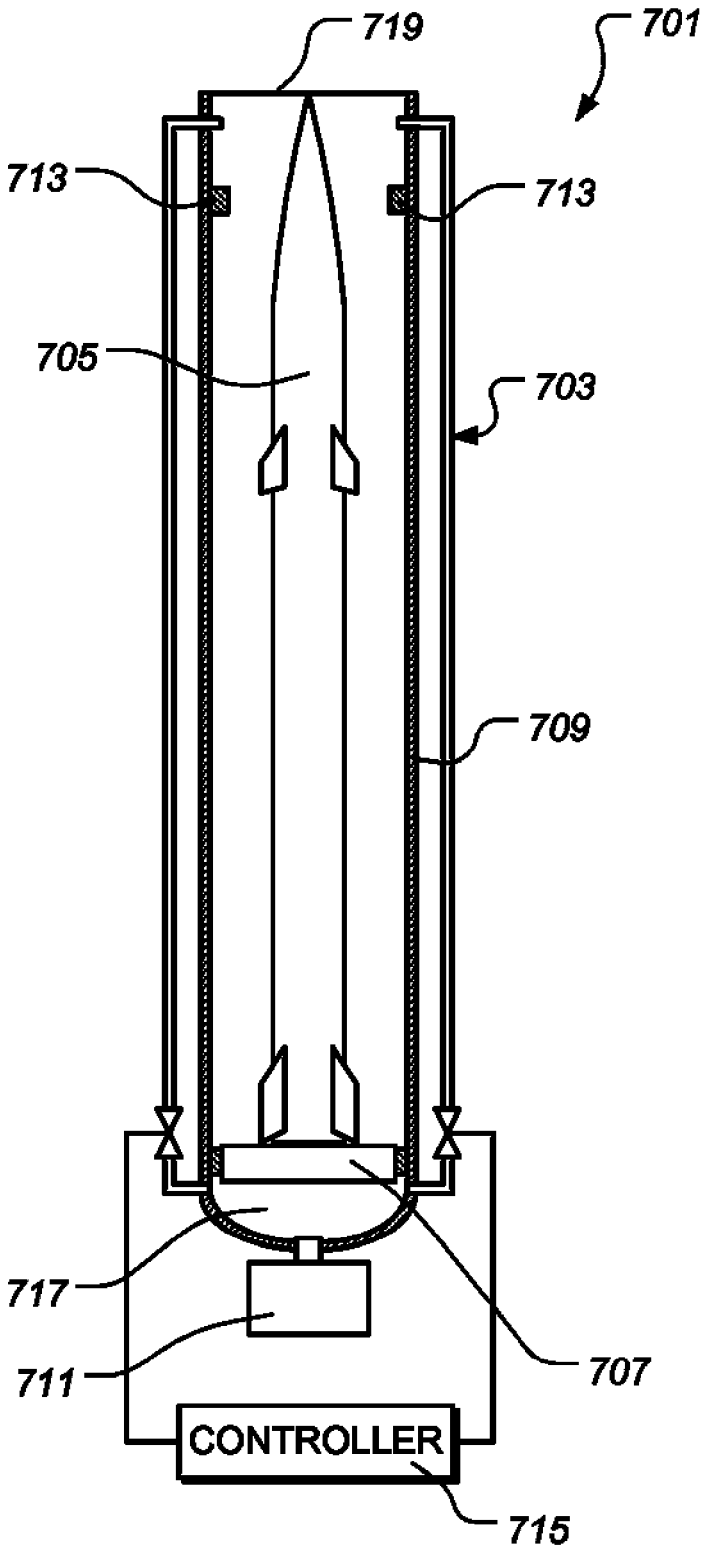
FIG. 7 is a stylized, side, elevational, partial cross-sectional view of a second illustrative embodiment of a projectile system.

Turning now to the embodiment illustrated in FIG. 7, projectile system 701 comprises set of valved conduits 703, projectile 705, a pusher plate 707, a canister 709, a launching means 711, pusher plate stops 713, and a controller 715. Projectile 705, canister 709, launching means 711, and pusher plate stops 713 generally correspond to projectile 105, canister 107, launching means 109, and pusher plate stops 111 of the first embodiment, shown in FIGS. 1-6. Canister 709 and pusher plate 707 define a closed volume 717 that corresponds generally to closed volume 115 of the first embodiment, shown in FIGS. 1-6. As in the first embodiment, when pressure within closed volume 717 is sufficient, the pressure urges pusher plate 707 and projectile 705 toward an opening 719 of canister 709.

Figure 8:
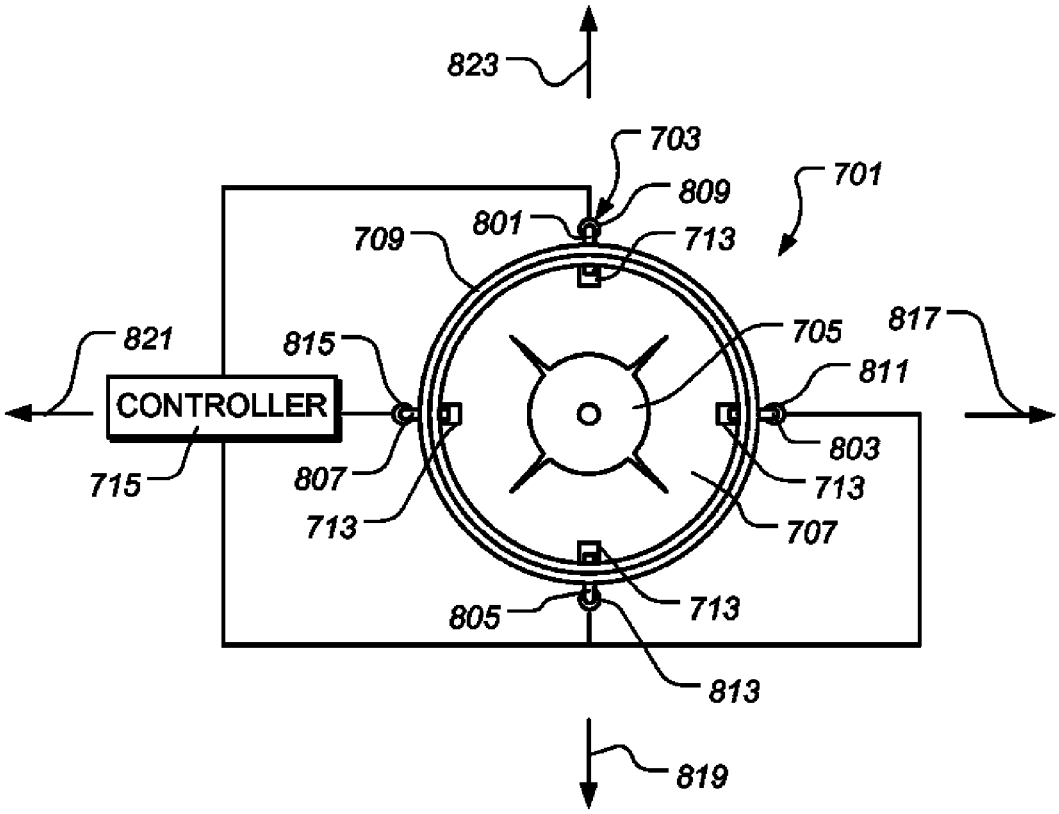
FIG. 8 is a stylized, top, plan view of the projectile system of FIG. 7.

Turning now to FIG. 8, the set of valved conduits 703 comprises a plurality of conduits 801, 803, 805, and 807 extending from closed volume 717 (shown in FIG. 7) of canister 709 to locations proximate opening 719 (shown in FIG. 7) of canister 709. Valves 809, 811, 813, and 815 are operably associated with conduits 801, 803, 805, and 807, respectively, to selectively allow exhaust gases generated by launching means 711 or other such launching means to flow through one of conduits 801, 803, 805, and 807. Controller 715 controls each of valves 809, 811, 813, and 815 are opened or closed and, in some embodiments, the degree to which each of valves 809, 811, 813, and 815 is opened. Controller 715 may form a part of the fire control computer of projectile system 701.

Figure 9:
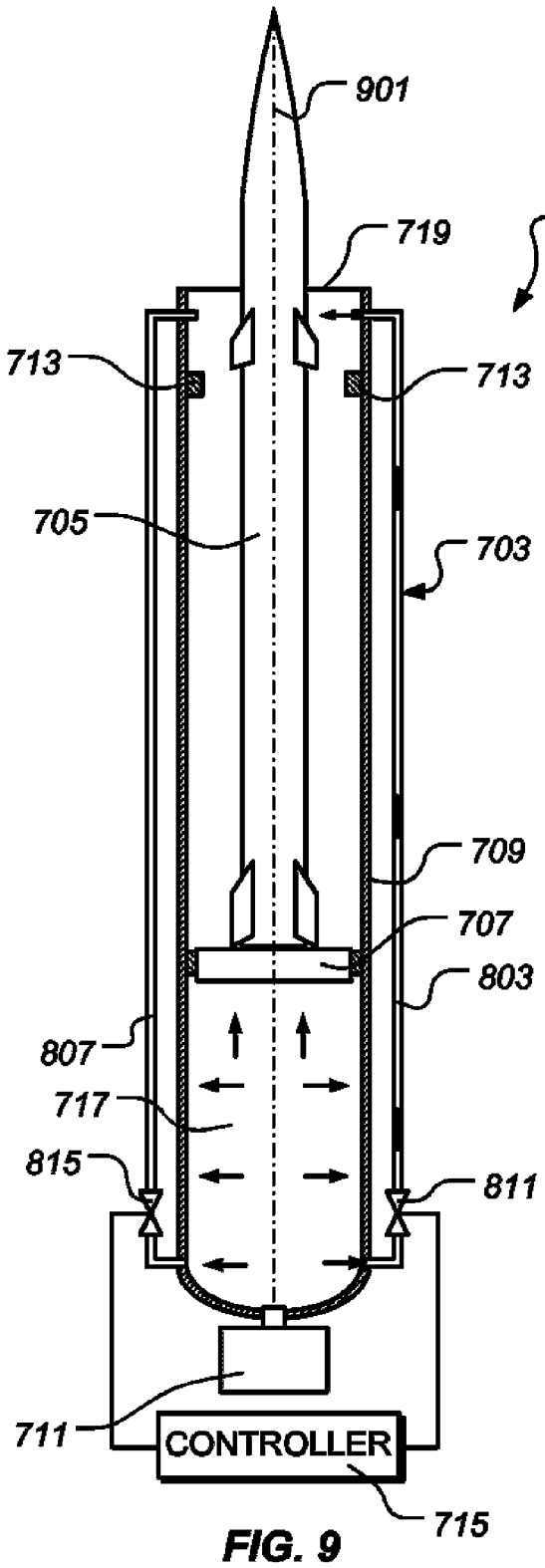
FIGS. 9 and 10 are stylized, side, elevational, partial cross-sectional views of the projectile system of FIG. 7 depicted in one particular mode of use.
Figure 10:
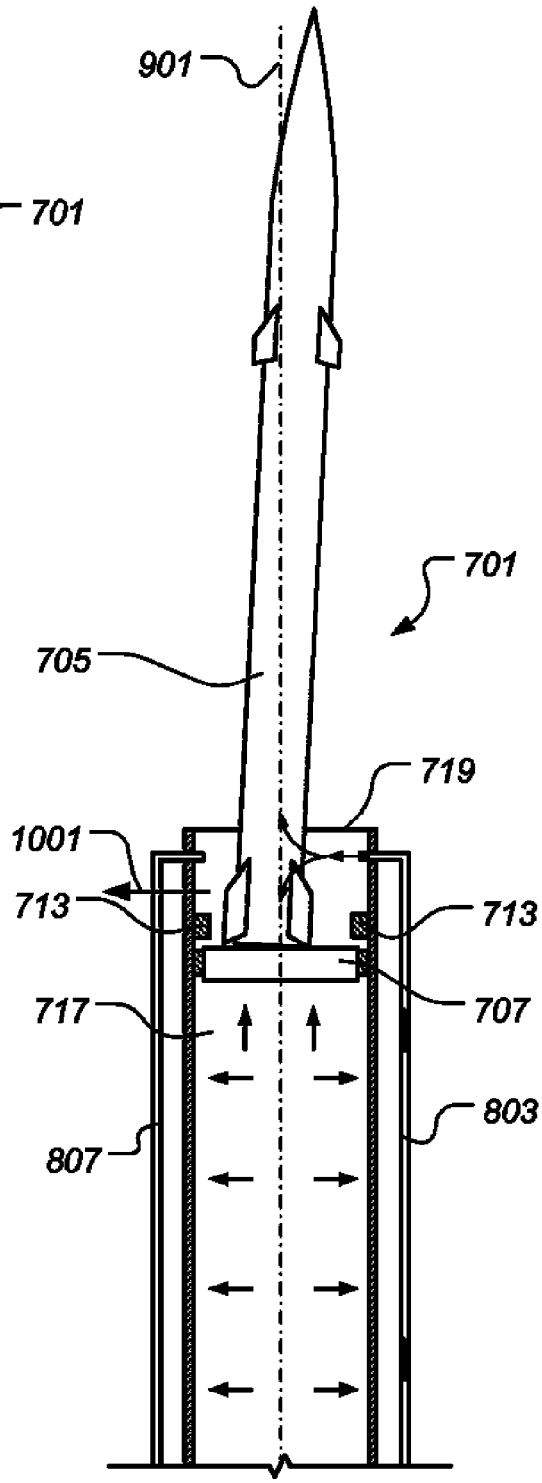

FIGS. 9 and 10 illustrate projectile system 701 in one particular operational configuration. As discussed herein, pusher plate 707 and projectile 705 are urged toward opening 719 of canister 709 as exhaust gases are introduced into closed volume 717 of canister 709. In the illustrated embodiment, valve 811 is opened by controller 715, thus allowing exhaust gases to flow through conduit 803 from closed volume 717 to proximate opening 719 of canister 709. Exhaust gases impinge on projectile 705, creating a lateral force, represented by an arrow 1001, acting on projectile 705. Lateral force 1001 moves projectile 705 with respect to pusher plate 707 and skews the orientation of projectile 705 with respect to a central, longitudinal axis 901 of canister 709. Thus, the exhaust gases that flow through one or more of conduits 801, 803, 805, and 807 affect the trajectory of projectile 705.

In the configuration depicted in FIGS. 9 and 10, exhaust gases flowing through conduit 803 causes projectile 705 to be steered in a direction generally corresponding to an arrow 817 of FIG. 8 during launch. Referring in particular to FIG. 8, if valve 813 is opened by controller 715 such that exhaust gases flow through conduit 805, projectile 705 is steered in a direction generally corresponding to an arrow 819. Similarly, if valve 815 is opened by controller 715 such that exhaust gases flow through conduit 807, projectile 705 is steered in a direction generally corresponding to an arrow 821. If valve 809 is opened by controller 715 such that exhaust gases flow through conduit 801, projectile 705 is steered in a direction generally corresponding to an arrow 823.

Pusher plate 103 (shown in FIGS. 1-6) and controller 113 (shown in FIGS. 1-6) make up one example of a means for directing exhaust gas to affect the trajectory of a projectile, such as projectile 105. Conduits 801, 803, 805, and 807 and valves 809, 811, 813, and 815 (best shown in FIG. 8) make up another example of a means for directing exhaust gas to affect the trajectory of a projectile, such as projectile 705.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. A projectile system, comprising:

a canister;

a pusher plate retained in the canister, the pusher plate having a sliding, sealing engagement with the canister to define a closed volume;

a projectile retained in the canister and resting on the pusher plate;

means for generating exhaust gas into the closed volume to urge the pusher plate and the projectile toward an opening of the canister; and means for directing the exhaust gas to create a lateral force on and affect the trajectory of the projectile.

2. The projectile system of claim 1, wherein the pusher plate comprises the means for directing the exhaust gas, the pusher plate comprising:

a multi-ported plate;

a single-ported plate having a breachable membrane covering a single port of the single-ported plate;

means for rotating the single-ported plate with respect to the multi-ported plate to generally align the single port with one of the ports of the multi-ported plate; and a controller for controlling an operation of the means for rotating the single-ported plate, wherein the exhaust gas is selectively ported from the closed volume to a space proximate the projectile via the single port of the single-ported plate and one of the ports of the multi-ported plate.

3. The projectile system of claim 2, wherein the means for rotating the single-ported plate comprises:

a motor mechanically coupled with the single-ported plate.

4. A method, comprising:

generating an exhaust gas into a closed volume defined by a pusher plate and a canister to launch a projectile from the canister; and selectively routing a portion of the exhaust gas to a space proximate the projectile to create a lateral force on and affect a trajectory of the projectile.

5. The method of claim 4, wherein selectively routing the portion of the exhaust gas is accomplished by:

providing the pusher plate with a multi-ported plate and a single-ported plate rotationally mounted to the multi-ported plate; and rotating the single-ported plate such that a single port of the single-ported plate is generally aligned with a desired port of the multi-ported plate to allow the portion of the exhaust gas to flow through the single port of the single-ported plate and the desired port of the multi-ported plate.

6. A projectile system, comprising:

a canister;

a projectile retained in the canister;

a pusher plate, retainable in the canister with the projectile configured to rest thereon, having a sliding, sealing engagement with the canister to define a closed volume; and launching engine configured to generate exhaust gas into the closed volume to urge the pusher plate and the projectile toward an opening of the canister, wherein the pusher plate is configured to selectively direct the exhaust gas to create a lateral force on and affect the trajectory of the projectile.

7. The projectile system of claim 6 further comprising a controller configured to control an operation of the pusher plate.

8. The projectile system of claim 6, wherein the pusher plate comprises a multi-ported plate and a single-ported plate having a breachable membrane covering a single port of the single-ported plate, a drive motor being configured to rotate the single-ported plate with respect to the multi-ported plate to generally align the single port with one of the ports of the multi-ported plate.

9. The projectile system of claim 8 further comprising a controller configured to control an operation of the drive motor.

10. The projectile system of claim 8 further comprising a gasket about the multi-ported plate.

11. The projectile system of claim 8, wherein the drive motor is configured to rotate the single-ported plate via a shaft.

12. The projectile system of claim 8, wherein the exhaust gas is selectively ported from the closed volume to a space proximate the projectile via the single port of the single-ported plate and one of the ports of the multi-ported plate.

13. The projectile system of claim 6, wherein the launching engine is configured to provide a motive force to urge the pusher plate and the projectile toward the opening of the canister.

14. The projectile system of claim 6 further comprising a pusher plate stop retainable in the canister configured to inhibit the pusher plate from exiting the canister.

* * * * *